United States Patent [19]

Allard et al.

[11] Patent Number: 4,657,511

[45] Date of Patent: Apr. 14, 1987

[54] INDOOR TRAINING DEVICE FOR WEAPON FIRING

[75] Inventors: Jean-Claude Allard, Bourg la Reine; René Briard, Orgeval; Christian Saunier, Ermont, all of France

[73] Assignee: Giravions Dorand, Suresnes, France

[21] Appl. No.: 680,396

[22] Filed: Dec. 11, 1984

[30] Foreign Application Priority Data

Dec. 15, 1983 [FR] France ..... 83 20137

[51] Int. Cl.[4] ..... G09B 9/00

[52] U.S. Cl. ..... 434/20

[58] Field of Search ..... 434/16, 19, 20, 21, 434/22

[56] References Cited

U.S. PATENT DOCUMENTS

| | | | |
|---|---|---|---|
| 3,996,674 | 12/1976 | Pardes et al. | 434/22 |
| 4,264,309 | 4/1981 | Brooksby | 434/20 |
| 4,276,028 | 6/1981 | Gwynn | 434/20 |
| 4,336,018 | 6/1982 | Marshall et al. | 434/22 |

FOREIGN PATENT DOCUMENTS

| | | | |
|---|---|---|---|
| 2456933 | 2/1980 | France | 434/22 |

*Primary Examiner*—Leo P. Picard

*Attorney, Agent, or Firm*—Felfe & Lynch

[57] ABSTRACT

A training device for indoor weapon-firing comprises a projector for displaying a sequence of moving images in visible light viewed by at least one firer and comprising a landscape with at least one target to be hit. Provision is made for at least one weapon equipped with a trigger mechanism and for an electronic computer assembly which has the function of controlling the emission of the infrared-radiation beam by means of the trigger mechanism. Another function of the electronic assembly is to stop the motion of projected images under the control of the trigger mechanism in order to interrupt the projection on one arrested visible image. A video camera serves to produce a video image of the arrested image and to selectively detect the trace of the infrared beam on the arrested image and to determine the trace location in its video image. A visible indication of the trace location is inserted electronically in the video image of the arrested image.

7 Claims, 2 Drawing Figures

INDOOR TRAINING DEVICE FOR WEAPON FIRING

BACKGROUND OF THE INVENTION

This invention relates to a training device for firing practice and, in particular, for indoor, weapon-firing exercises.

A device for training one or a number of weapon firers indoors has at least one weapon equipped with a trigger mechanism for operation by the firer and a fire-simulating infrared-beam emitter, the emission of which is initiated by the trigger mechanism. The emitter is, for example, a laser that, advantageously, can be mounted on a real weapon such as a semi-automatic or automatic individual weapon, individual antitank weapon, collective antitank weapon such as rockets, recoilless guns, missiles, or turret-mounted ballistic-projectile weapons, for example.

In this, indoor, weapon-firing-training field, interest is primarily focused on inexpensive, basic equipment which involves minimimum operating costs but nevertheless assures adequate preliminary training of firers prior to outdoor weapon-firing exercises, especially for training in the handling of infantry weapons for which it is often adopted. In view of the small size of infantry weapons and, especially, the so-called "small arms" thereof, however, it is not possible to mount a bulky fire-simulating emitter on an infantry weapon or, especially, the small arms thereof.

SUMMARY OF THE INVENTION

In order to meet the requirements mentioned in the foregoing, the invention proposes a training device which offers the advantages of low cost, light weight and simple operation for indoor training in weapon-firing, especially of an infantry weapon, with adaptation of only a small-size infrared radiation emitter to the weapon itself.

The training device in accordance with the invention has a certain number of known elements which are employed in a conventional manner, as in similar applications. Thus, a recording-playback projector displays, in front of the firer, a stationary or moving, visible image of a landscape on which at least one target to be hit is also displayed, said target also being stationary or moving on the landscape.

In regard to the projector just mentioned, one of the advantages of the invention lies in the fact that it is unnecessary to provide the recording in a particular type. A simple motion-picture recording on ordinary film is perfectly suitable, and the same applies to a video recording. In one case as in the other, the target (or targets, if there is more than one) can be projected from the same recording or a recording different from that of the landscape and superimposed on the landscape at the time of projection. The landscape itself can either be stationary and reproduced from a single photograph or else it can move in a sequence of images. Preference will often be given, however, to the simplest solution which consists in projecting a pre-filmed landscape on which one or a number of targets were moving at the time of filming.

The training device also has a device for automatically stopping the movement of the projected images on one, arrested visible image, this device being controlled by the trigger mechanism of a weapon of the training device.

In a preferred embodiment, this stopping device stops the movement of the projected landscape and target images to fix the field of view comprising both in a position in which an instructor and the firer have all the time they desire to observe the result of a shot which has been fired.

In another embodiment, the arrested visible image is simply recorded at a stopping instant defined by the stopping device or its equivalent without resulting in actual or prolonged arrest of the image projected when the shot is fired. Display of the arrested image will, in that case, be deferred to a subsequent time for study of the results of the firing. This is particularly useful in the case of multiple shots.

In a preferred embodiment of the invention to which reference will be made more particularly hereinafter, the video device for producing the video image of the arrested image has a video camera which is positioned so as to observe a screen on which the projector projects the image of the landscape and target. The function of said video camera is to provide successive video signals of images on the screen in order to transcribe selected ones. The selection may be according to a choice made by an instruction who has at his disposal a video monitor for displaying the video signals together with a control therefor, for example.

However, the video device also has a retractable filter interposable across the path of the rays from the screen to the video camera. When the retractable filter is so interposed, it serves to make the camera temporarily sensitive solely to infrared rays within the range of wavelengths of the rays produced by the emitter carried by the weapon whereas, when the retractable filter is retracted to be not so interposed, the camera is sensitive to the landscape and target images projected onto the screen.

In this form of construction, the training device in accordance with the invention further has controls which are actuated by the trigger mechanism to retract the aforementioned filter and stop or arrest the movement of the landscape and target, projected images. While the filter is still interposed across the path of the rays reflected from the projection screen to the camera, however, the video signal makes it possible to define the position of the infrared-ray spot or trace on the screen from the laser emitter. When stopping of the moving-image projection and retraction of the filter, by pivotal displacement, for example, then take place, the projected landscape and target image which appears on the screen is completely acquired by the camera and can then be retransmitted to the video monitor while superimposing thereon a transcribed representation of the impact point which is inserted in the image in accordance with the coordinates of the previously determined infrared spot. To this end, the invention advantageously has an electronic microprocessor assembly for singal-processing.

Although offering simplicity of construction, the training device in accordance with the invention nevertheless constitutes a high-precision instrument because the same equipment (except for the filter) has the function of detecting on the same screen the projected image of the landscape and target as well as the point of impact of the shot which has been fired. The corresponding information is then presented in the same video signal for displaying the superimposed images and any errors in deflection, position or linearity have no effect on the appreciation of the results of the shot. Initial adjustments of the system are partically non-existent. All these advantages are obtained without any need to employ a film of special design for a projection.

In accordance with another distinctive feature of the invention, the training device has an arrangement for correcting, in a predetermined manner, either the direction of the infrared beam with respect to the line of sight of the weapon at the time of firing or, preferably, the position of the beam trace detected just before the arrested image at the time of its insertion into the video image. This arrangement makes it possible, particular, to take into account the effect which would have been produced by the trajectory of a projectile of the shot if the shot were real and not simulated.

A further point worthy of note is that the trace of the infrared beam which is detected and a representation of which is inserted into the arrested image can be either point-like (and represented by a cross, for example) or linear, constituted by a plurality of points detected at different instants prior to stopping the projected image, in order to define the path of a missile.

As has already been inferred, the use of a suitable computer makes it possible to take different data into account for each shot fired. Such data can include the characteristics of the weapon used, the ballistic characteristics of the corresponding simulated ammunition, aerological disturbances, and data relating to target (distance, position, displacement, size or the like). Data of this type may be provided by the landscape and target projection apparatus which contains them, for example, on one of the tracks of film therefor ordinarily used for sound.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
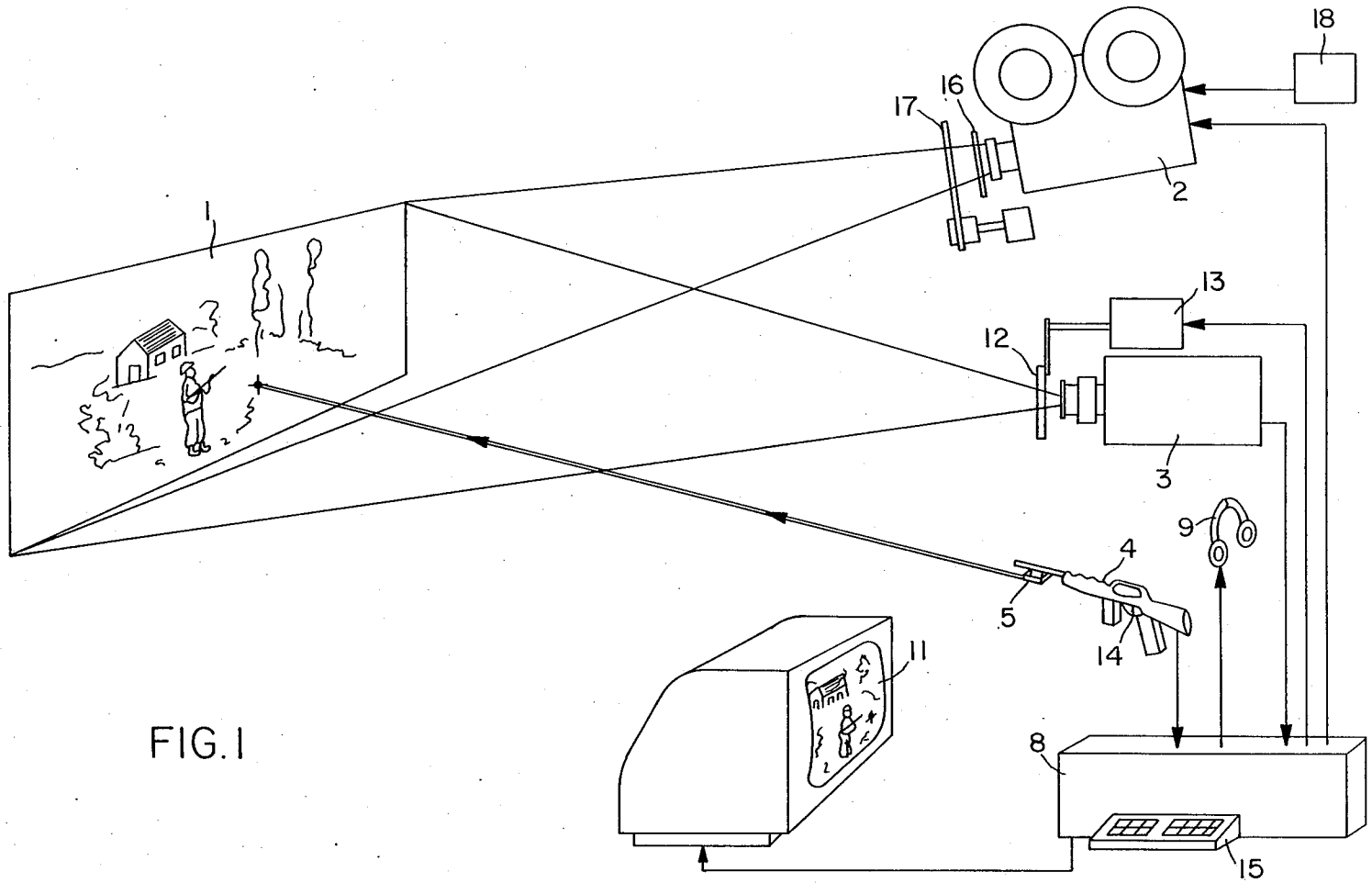
FIG. 1 is a schematic representation of all the essential elements constituting the training device for weapon-firing.
Figure 2:
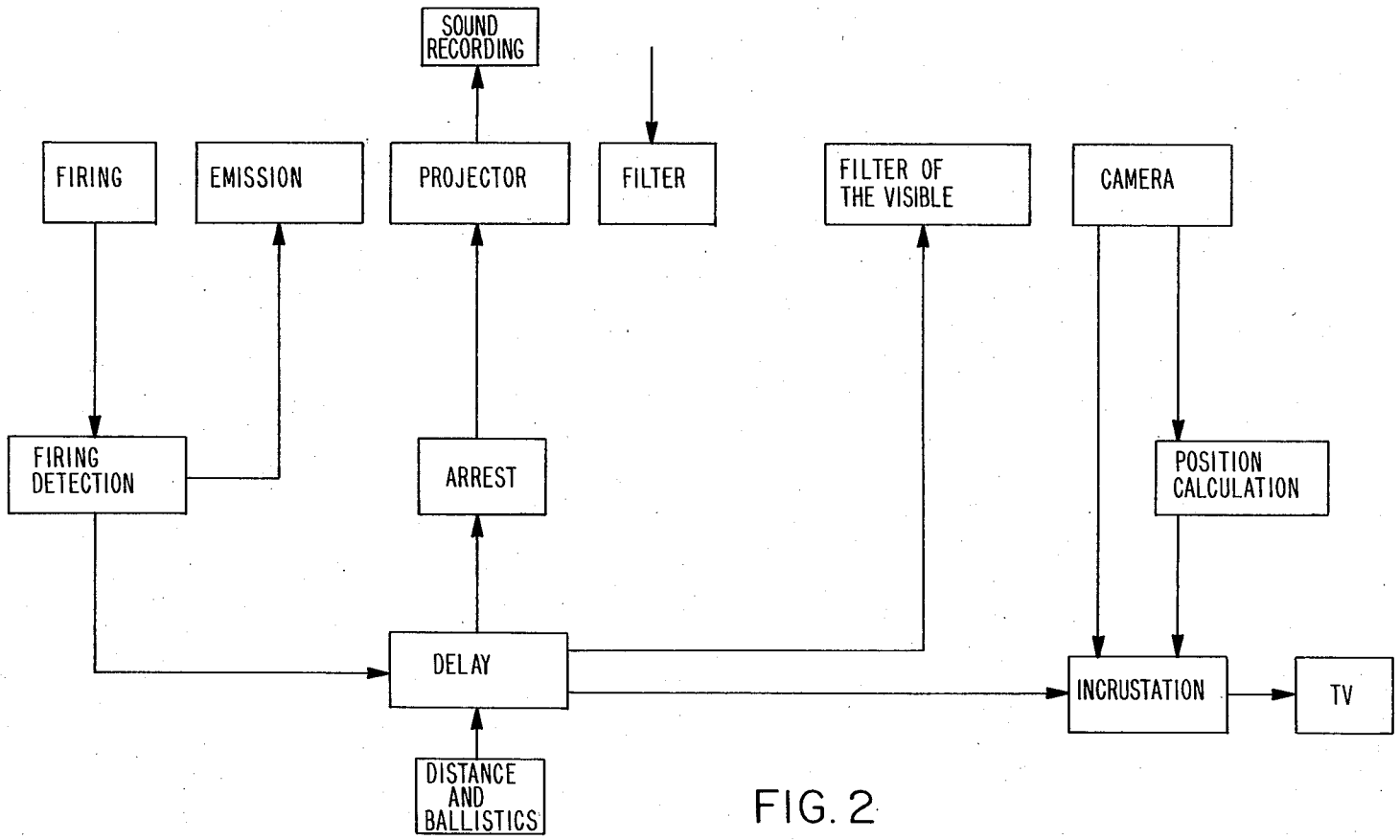
FIG. 2 is a block diagram in which the functions performed within the computer are shown in detail.

FIG. 1 illustrates an image display screen 1, a projector 2 of any conventional type as employed in cinematography for the projection of developed motion-picture films and connected to a sound-reproduction baffle 18, a video camera 3 and a rifle 4. The barrel of the rifle is adapted to carry a laser emitter 5 which is capable of controlled emission of a pulsed infrared light beam.

The projector 2, video camera 3 and rifle 4 are oriented towards the same screen 1. Focusing of the projector 2 is so adjusted as to produce a sharp image on the screen 1. The camera 3 re-takes an image from screen and transcribes it by scanning in a video image whilst the firer orients the rifle so as to aim at a target which appears on the screen.

It is assumed in the arrangement which is illustrated by way of example that the target is integrated in the projected motion-picture film which represents a landscape in which the target is moving. It will be apparent that the same landscape can just as readily contain a plurality of targets to be selected by the firer. However, the target or targets could also be obtained from a different projector in order to be projected on the same screen in superimposed relation, for example, to a fixed landscape obtained from a diapositive projector.

In other variants which form part of the invention, the motion-picture projector could be replaced by a video projector controlled by a video signal which contains all the data relating to the landscape and to the target for the purpose of reconstructing the corresponding images on the screen 1. Furthermore, both the landscape image and the target image (or only one of the two) can be derived from previously recorded images of real objects or can be produced by electronic synthesis in the video signal.

In other alternative forms of construction, the motion-picture projector can be replaced by a diapositive projector for the landscape background, the target and representation of impacts being generated synthetically by a video projector and superimposed on the landscape on the screen 1.

The projector 2, video camera 3 and rifle 4 are all operatively connected to an electronic control assembly constituted by a microprocessor computer 8 associated with a control desk 15 for the use of the instructor who is in charge of firing exercises. A headset 9 which is also controlled by the computer 8 can be worn by the firer in order to hear a sound which represents the firing of a real shot as soon as he presses the trigger of the rifle 14 in order to initiate a frictitious shot. In addition to transmission of the control orders which will hereinafter be explained, the essential function of the computer 8 is to process the video signals. Thus the computer continuously scans the signal derived from the video camera 3 while determining the signal which controls projection of the images on a television screen 11. This screen is positioned for viewing by the instructor and preferably also by the firer or firers in order to enable them to determine the results of shooting. Should there be more than one firer, a number of video monitors can be connected in parallel.

In fact, the device described here in a relatively simple form of construction in which it is used by only one firer who operates a single rifle can be modified in design arrangements which are apparent to any one versed in the art so as to permit adaptation to several firers working with the same instructor. If necessary, it can be made possible in this case to distinguish the results of the different shots fired by the different persons, either by virtue of the fact that they have aimed at different targets or by displaying on the television screen 11 points of impact produced by different shots as represented by different identification symbols, or else by assigning to the laser emitters of the different rifles different codes for the laser pulse trains which are identified by the computer at the time of firing. It will also be cearly understood that the rifles can be replaced by any other type of weapon which is adapted to indoor training.

In the case of the figures which illustrate the present description, there has also been shown a single video camera. This camera 3 is equipped with a retractable filter 12. This filter absorbs visible light but permits selective traversal by radiations within the same range of wavelengths as the beam produced by the laser emitter. It may be assumed by way of example that consideration is given to infrared radiation having a wavelength of 0.9 micron. In the active position shown, the filter 12 is interposed in front of the camera lens which is therefore sensitive solely to this infrared radiation. The filter is mounted on the shaft of a rotating electromagnet 13 which is controlled by the computer and serves to withdraw the filter in a movement of pivotal displacement away from the path of the light rays between the projection screen and the camera. This pivotal displacement of the filter is controlled by the computer 8 which also initiates laser emission at the time of firing of the shot. A sufficient time interval is nevertheless allowed to elapse between the two actions in order to ensure that the laser beam reflected from the screen is received by the camera and detected in the video signal prior to pivotal displacement of the filter.

It will be understood that detection by the camera 3 and scanning of the video signal by the computer consequently make it possible in a first stage to detect the position of the laser-beam trace on the projection screen and to determine the coordinates of said trace before analyzing in a second stage all the data relating to the image projected by the projector 2 at least within the entire range of visible light radiations. This projection nevertheless takes place on the screen 1 during the entire period of time in which the firer prepares his aim up to the moment of firing a shot. In order to prevent any disturbance of the image which is then picked-up by the camera in infrared radiation, it may prove desirable to place in front of the projector an infrared-radiation absorption filter which removes the infrared radiation at least within the range of wavelengths passed by the filter 12 which is placed in front of the camera.

At the moment of firing of the shot, the computer 8 also initiates stopping of the motion of the film within the projector so that, in the projected images, both the landscape and the target then remain fixed in the position in which they had been located at the instant of firing. This so-called "arrested image" is represented in the video signal and retransmitted by the computer to the monitor for display on the television screen 11. The computer also initiates the appearance on the screen, by insertion in the video signal, of a symbol such as a cross, for example, which indicates the point of impact in the position previously determined by the computer for the trace of the laser beam. On the television screen, the instructor and the firer can therefore observe the results of firing and discuss them at leisure, on the image of the landscape and of the target which has been "frozen" or arrested at the instant of firing.

In the embodiment described thus far, the device in accordance with the invention is well-suited without restriction for training in weapons such as rifles which discharge direct-trajectory projectiles over distances which have a negligible incidence. However, improvements can be made in the device in order to adapt this latter to different applications.

In the case of firing by means of a rocket-launcher, it is an advantage to take into account the elevation introduced by the ballistic trajectory as well as the distance traveled by the projectile. Simulation of the distance effect can be carried out by programming the computer so as to impose at the time of stopping of projection of landscape and target images a time-delay counted from the instant of firing and corresponding to the time of flight of the projectile over the distance which has been evaluated beforehand either by direct indication of the instructor or by reading coded data derived from the projection film or like image medium. In regard to simulation of the ballistic trajectory, this can be performed by correcting, by the value of the highest point of the trajectory calculated in respect of said distance, the position of the point of impact between its detection by the camera at the time of emission of the laser beam and its representative symbol in the display on the video screen. Different aerological or other disturbances which have an influence on the trajectory of the projectile may also be introduced. Adequate coding of the laser pulses in respect of each type of weapon adopted for simulated shooting enables the computer to apply the corresponding ballistic corrections. Shots fired by different weapons can thus be simulated simultaneously.

In other alternative forms of construction, it may prove advantageous to employ successive pulse trains of the laser emission. In particular, if the weapon is intended to fire a missile which the firer is capable of guiding with respect to the line of sight, recording by the camera of the traces produced on the projection screen by these successive laser pulses permits continuous storage of the path corresponding to the gunsight reticle. This complete path can be caused to appear by insertion in the video signal on the landscape which is reproduced together with the target in its position at the moment of impact. Successive laser pulses can also serve to simulate firing by bursts. It is possible for example to produce trains of laser pulses at the frequency of machine-gun fire and to effect insertion in the video signal by indicating the different points of impact. Since the image of the landscape is frozen, whether its arrested position is that of the beginning or end of firing, this means that displacement of the target or targets during a burst of fire can be disregarded.

The point of impact referred-to throughout the foregoing description corresponds to the point of travel of the projectile in the vertical plane located at the level of the target and perpendicular to the line of sight from firer to target.

In an improved embodiment of the device herein described, the projection system is provided with a light-attenuating optical filter which makes it possible to simulate a night-exercise environment when so ordered by the instructor. This filter is accordingly interposed in front of the camera lens while the firer is taking aim but is withdrawn after the shot has been fired, with the result that the camera produces an image which is fully illuminated for viewing the result of the shot. An accessible control element on the control desk enables the instructor to contorl positioning of the filter by means of a rotary electromagnet 18.

In addition, the device can be equipped with various mechanisms carried by the weapon for simulating special effects. By way of example, a recoil effect can be provided by a weapon displacement initiated at the instant of firing. A shaking motion can be obtained in particular by means of a vibrating mass mounted on the weapon and controlled by an electromagnet or by an injection of air.

Finally, if the primary object of interest lies in the particular example hereinabove described with reference to the accompanying drawings and in the event that stopping of projected images actually takes place at the moment of firing, this case is not limitative in an alternative embodiment in which the arrested image is not examined immediately after firing but is recorded. This embodiment will prove advantages in many instances, especially in the event of simultaneous training of a number of firers. Thus at the same time as the video image of the arrested image defined by the same instant of stopping as in the alternative embodiment with effective stopping, a recording is made of all the data required for characterizing the corresponding shot and the insertion data relating to the impact. The movement of images is not stopped and recording continues for several shots produced by one and the same firer or by different firers. The results of the shots are examined by the instructor and the trainees in a subsequent stage in which the entire film is re-run. At this stage, image motion is effectively stopped at the instant corresponding to each shot in order to permit a study of the position of the impact inserted in the arrested image.

It will be readily apparent that all the variants mentioned in the foregoing are only examples and that the invention is not limited to these particular cases.

What is claimed is:

1. An indoor training device for weapon firing, comprising:

a screen;

projection means in front of the screen for displaying a moving image including at least one target on the screen in visible light;

at least one weapon in front of the screen, the weapon having a trigger mechanism for operation by a firer and an infrared-beam emitter;

means responsive to operation of the trigger mechanism for causing the emitter to emit an infrared beam, whereby to simulate a projectile form the weapon with the infrared beam;

a video camera in front of the screen for transcribing a video image of the screen;

a retractable filter for passing at least one radiation wavelength of only the infrared beam so interposed between the screen and the video camera that the video camera transcribes only a video image of a trace of the infrared beam on the screen while the retractable filter is so interposed;

means responsive to operation of the trigger mechanism for stopping the projection means, whereby to arrest the moving image including the at least one target therefrom, and for retracting the retractable filter from being so interposed between the screen and the video camera, whereby the video camera transcribes a video image of the arrested image including the at least one target; and means for electronically superimposing the transcribed video image of the infrared beam and the video image of the arrested moving image and displaying the same.

2. The device according to claim 1, and further comprising means for imposing a predetermined time-delay between the operation of the trigger mechanism and the response thereto of the means for stopping the projection means.

3. The device according to claim 1, and further comprising correcting means for correcting the position of the trace in a predetermined manner by the time superimposed in the displayed video image.

4. A device according to claim 3, wherein said device comprises means for correcting in a predetermined manner the direction of the infrared-radiation beam with respect to the line of sight of the weapon.

5. A device according to claim 4, wherein provision is made for a plurality of weapons as well as means for distinguishing the traces of the corresponding infrared-radiation beams on the arrested image.

6. The device according to claim 1, wherein the projection means further comprise a filter for absorbing radiations therefrom having the wavelength of the infrared-beam of the emitter.

7. A device according to claim 6, wherein said device comprises a light-attenuating filter for simulating a nighttime environment in the projection means, said filter being retractable under the control of the trigger mechanism.

* * * * *